US007658512B2

(12) United States Patent
Van Oers et al.

(10) Patent No.: US 7,658,512 B2
(45) Date of Patent: Feb. 9, 2010

(54) LIGHTING UNIT

(75) Inventors: Denis Joseph Carel Van Oers, Eindhoven (NL); Jelle Hilbrand Schuurmans, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 1097 days.

(21) Appl. No.: 10/510,471

(22) PCT Filed: Apr. 11, 2003

(86) PCT No.: PCT/IB03/01497

§ 371 (c)(1),
(2), (4) Date: Oct. 6, 2004

(87) PCT Pub. No.: WO03/087664

PCT Pub. Date: Oct. 23, 2003

(65) Prior Publication Data

US 2005/0141223 A1 Jun. 30, 2005

(30) Foreign Application Priority Data

Apr. 11, 2003 (EP) ..... 02076446

(51) Int. Cl.
*F21V 7/00* (2006.01)

(52) U.S. Cl. ..... 362/296.01; 362/263

(58) Field of Classification Search ..... 362/296, 362/539, 25, 263, 255, 351; 313/113, 578, 313/580

See application file for complete search history.

(56) References Cited

U.S. PATENT DOCUMENTS 4,344,119 A 8/1982 Bergot
6,435,704 B1 * 8/2002 Montet et al. ..... 362/539

FOREIGN PATENT DOCUMENTS

DE 29809619 7/1998
EP 03336478 10/1989

* cited by examiner

*Primary Examiner*—John A Ward

(57) ABSTRACT

The invention relates to a lighting unit (1) having a concave reflector (2) with an axis of symmetry (3) and a light emission window (21) bounded by a circumferential edge (20) transverse to the axis, an elongate light source (30) extending substantially along the axis of symmetry (3), which light source (30) is accommodated in a holder (4) opposite the light emission window (21), and a cup-shaped axially positioned cap (5), which cap partly surrounds the light source and forms an optical screening means to intercept unreflected light rays. According to the invention, the cap (5) is surrounded at a distance d by a screening ring (50), which extends over a height h in the direction of the light emission window (21).

15 Claims, 3 Drawing Sheets

LIGHTING UNIT

Figure 1:
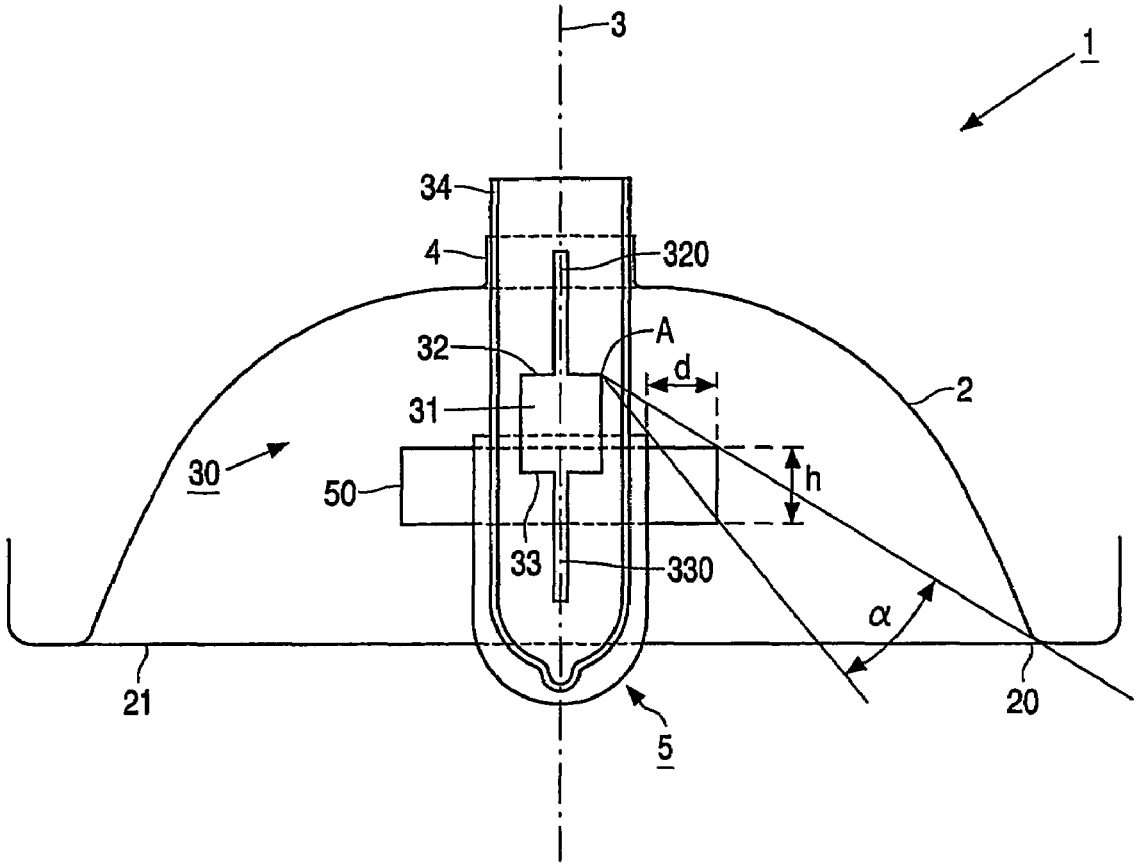

The invention relates to a lighting unit provided with a concave reflector having an axis of symmetry and with a light emission window bounded by an edge of the reflector which surrounds the axis transversely thereto, an elongate light source which is axially arranged substantially on the axis of symmetry and which is accommodated in a holder opposite the light emission window, and a cup-shaped axially positioned cap serving as an optical screening means that partly surrounds the light source for intercepting unreflected light rays.

A lighting unit of the kind mentioned in the opening paragraph is known from EP 0336478. The light source is a discharge vessel provided with an outer envelope. The outer envelope is provided with a cap impermeable to light at the side facing the light emission window. The concave reflector is provided with a collar at its circumferential edge, which collar has a stepped wedge shape at the side facing the axis of symmetry. The collar serves to intercept unreflected light originating from the light source as far as the latter is located between the cap and the holder of the light source.

The known lighting unit has the disadvantage that the collar leads to a considerable size of the lighting unit in axial direction, which is unfavorable for building-in of the lighting unit. A further disadvantage is that the wedge shape of the collar screens off part of the light emission window.

The invention has for its object to provide a means for eliminating said disadvantages. According to the invention, a lighting unit of the kind mentioned in the opening paragraph is for this purpose characterized in that the cap is surrounded at a distance d by a screening ring which extends over a height h in the direction of the light emission window. Unreflected emission of light originating from the portion of the light source located between the cup-shaped cap and the holder can be effectively prevented by the positioning of the screening ring impermeable to light, without this leading to a necessary increased dimension of the lighting unit in axial direction. If the screening ring extends parallel to the axis of symmetry, it is achieved at the same time that the screening ring causes no appreciable screening of the light emission window.

At the side facing the holder, the screening ring preferably extends up to a plane transverse to the axis of symmetry and defined by the cup-shaped cap. This prevents the screening ring itself from screening off the light source from the reflector. The height h of the screening ring is associated with the maximum value of an angle $\alpha$ viewed from the light emission window and bounded by the circumferential edge and the cup-shaped cap, within which angle the portion of the light source between the cap and the holder is visible without a screening ring. Preferably, the height h is chosen such that the screening ring completely cuts off the angle $\alpha$. The distance d of the screening ring to the cup-shaped cap is preferably chosen such that the screening ring extends up to the boundary of the angle $\alpha$ between the light source and the circumferential edge.

In an alternative embodiment, the screening ring forms part of a conical surface with a maximum apex angle of 10°. Given a conical shape with the apex angle at the side of the light emission window, the screening ring is advantageous for a reflector forming a converging beam. The screening ring in this case has a reduced surface area while the screening of the angle $\alpha$ remains the same. If the reflector forms a somewhat diverging beam, a screening ring forming part of a conical surface with an apex angle at the side of the holder is advantageous for reducing the interception of reflected light to a minimum.

To influence the light distribution realized by the reflector in the light emission window as little as possible, preferably, the screening ring is provided with a light-absorbing surface at its side facing the light source. In a further preferred embodiment, the cup-shaped cap and the screening ring are provided with light-absorbing surfaces.

The light source may be formed by an incandescent body, for example an incandescent coil, or by a discharge generated in a discharge vessel. Suitable preferred discharges are high-pressure sodium discharges and metal halide discharges. In either case, the discharge vessel is preferably formed from a ceramic material, this term denoting in the present description and claims sapphire, densely sintered polycrystalline metal oxide, for example aluminum oxide, and densely sintered polycrystalline aluminum nitride. It is a general property of ceramic discharge vessels that they are translucent, but not or substantially not transparent. In such cases, the portion of the discharge vessel surrounding the discharge forms the spatial boundary of the light source. Very compact light sources can be manufactured by means of such discharges because of their high efficacy, which light sources are highly suitable for realizing compact dimensions of the lighting unit according to the invention in combination with favorable beam properties. A metal halide light source has the favorable properties that very good color characteristics can be realized thereby and that it has a long operational life.

Figure 2:
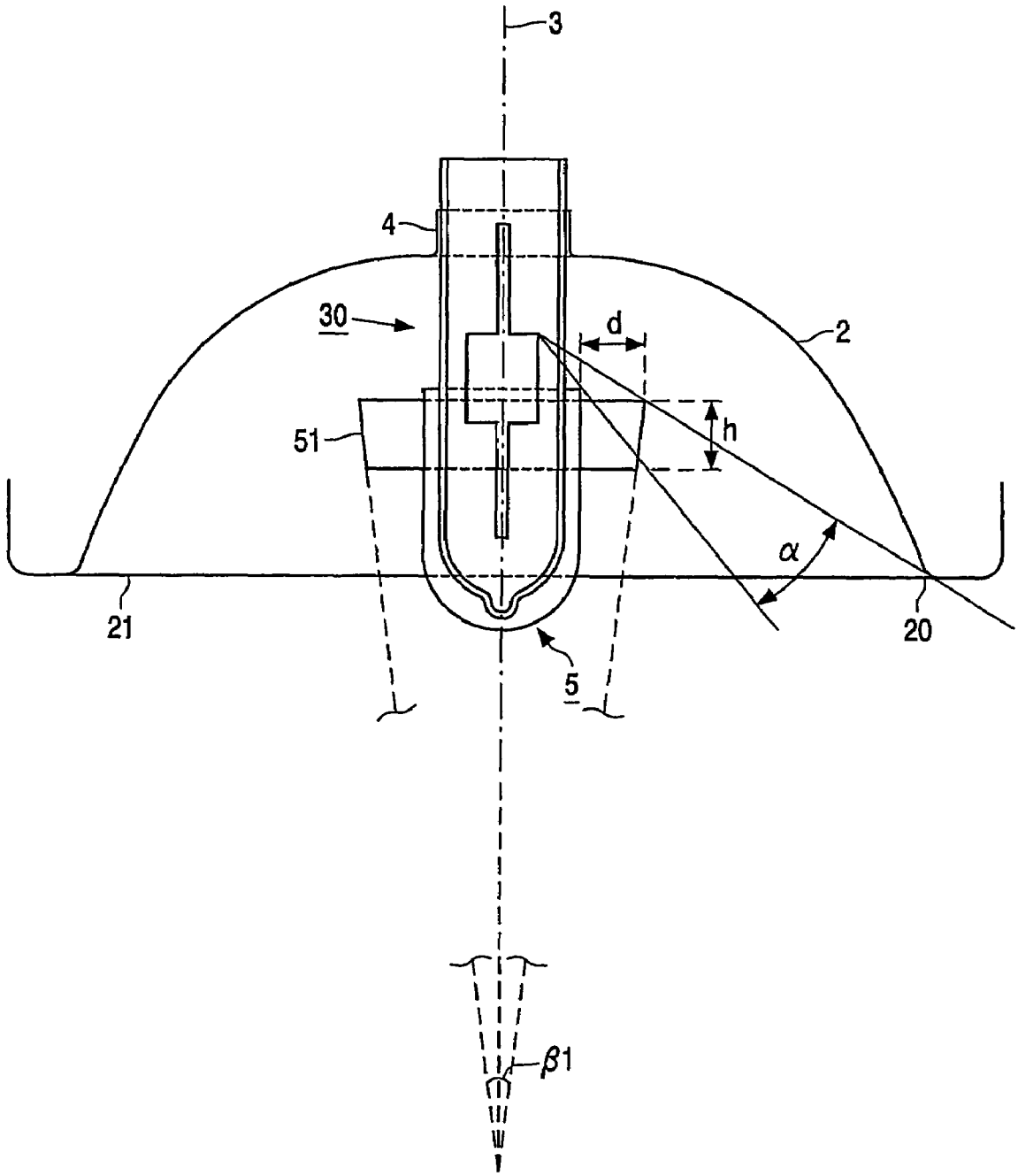
Figure 3:
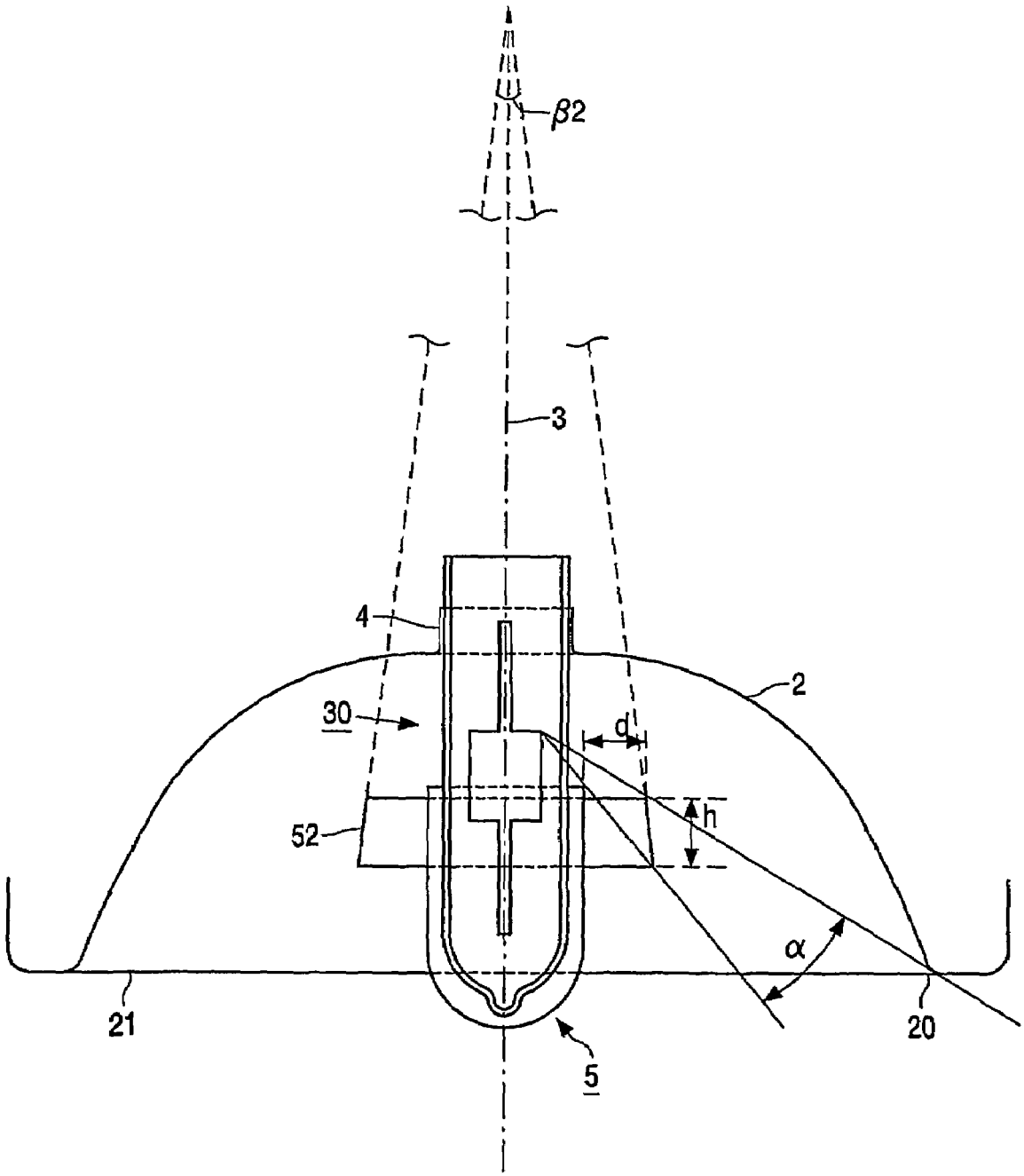

The above and further aspects of the invention will be explained in more detail with reference to a drawing, in which FIG. 1 is a cross-sectional view of a lighting unit according to the invention, and FIGS. 2 and 3 show alternative embodiments of the lighting unit.

FIG. 1 of the drawing shows a lighting unit 1 according to the invention provided with a concave reflector 2 with an axis of symmetry 3 and a light emission window 21 bounded by a circumferential edge 20 of the reflector which is transverse to the axis. An elongate light source 30 arranged substantially axially on the axis of symmetry is accommodated in a holder 4 opposite the light emission window. The light source is partly surrounded by an axially arranged cup-shaped cap 5 serving as an optical screening means for intercepting unreflected light rays.

In the embodiment shown, the light source is formed by a ceramic discharge vessel 31 provided with external closing plugs 320, 330 at axial end faces 32, 33 for positioning lead-through elements (not shown) to electrodes positioned in the discharge vessel, between which a discharge takes place in the operational state. This discharge is a metal halide discharge in the example described. The discharge vessel is held in an outer envelope 34, which is indetachably connected to the holder 4 in the case described. The reflector and the light source have thus been integrated into a metal halide lamp.

The cup-shaped cap 5 is surrounded by a screening ring 50 at a distance d, which ring extends over a height h in the direction of the light emission window 21.

A point A of the discharge vessel 31 together with the circumferential edge 20 and the cup-shaped cap 5 defines the maximum value of an angle $\alpha$ viewed from the light emission window, within which angle the portion of the light source situated between the cap and the holder is visible without a screening ring. The distance d and the height h are chosen such that the entire angle $\alpha$ is cut off, so that the presence of unreflected light in the plane of the light emission window is advantageously prevented. Light reflected against the reflector adjacent the holder, however, can issue to the exterior substantially without interference.

In FIGS. 2 and 3, lighting units are shown with a reflector 2, light source 30, and cup-shaped cap 5 identical to those of FIG. 1. In FIG. 2, the screening ring 51 is formed as part of a conical surface with an apex angle β1 of 10° at the side of the light emission window 21. In the embodiment of FIG. 3, the screening ring 52 is part of a conical surface formed with an apex angle β2 of 10° at the side of the holder 4.

In an advantageous embodiment, the cup-shaped cap forms part of a sleeve fastened to the holder. The sleeve is preferably made of hard glass, which is resistant at least to a temperature of 600° C., or of quartz glass. A suitable shaping of the sleeve renders it possible to form the cup-shaped cap and the screening ring as one integrated body. A coating impermeable to light is provided on the sleeve at the area of the cap and the screening ring. The coating may be formed by materials, which are known per se, for example a metal such as aluminum, or a solution of carbonyl iron and silicon. The coating may be provided in various ways, such as with a brush, by a printing technique, or by spraying, for example with an ink jet.

In a further advantageous embodiment, the holder is provided with an electrical connection contact for connecting an electrical supply source via a plug. The concave reflector may advantageously be manufactured from aluminum.

The invention claimed is:

1. A lighting unit provided with a concave reflector having an axis of symmetry and with a light emission window bounded by an edge of the reflector which surrounds the axis transversely thereto, an elongate light source which is axially arranged substantially on the axis of symmetry and which is accommodated in a holder opposite the light emission window, and a cup-shaped axially positioned cap serving as an optical screening means that partly surrounds the light source for intercepting unreflected light rays, characterized in that the cap is surrounded at a distance d by a screening ring which extends over a height h in the direction of the light emission window.

2. A lighting unit as claimed in claim 1, characterized in that, the screening ring extends at the side facing the holder up to a plane transverse to the axis of symmetry and defined by the cup-shaped cap.

3. A lighting unit as claimed in claim 1 or 2, characterized in that the screening ring forms part of a conical surface with a maximum apex angle of 10°.

4. A lighting unit as claimed in claim 1, wherein the reflector and the light source are indetachably integrated into a lamp.

5. A lighting unit as claimed in claim 4, characterized in that the lamp is a metal halide lamp with a ceramic discharge vessel.

6. A lighting unit provided with a concave reflector having an axis of symmetry and with a light emission window bounded by an edge of the reflector which surrounds the axis transversely thereto, an elongate light source which is axially arranged substantially on the axis of symmetry and which is accommodated in a holder opposite the light emission window, and a cup-shaped axially positioned cap serving as an optical screening means that partly surrounds the light source for intercepting a first portion of unreflected light rays from the light source, characterized in that the cap is surrounded by a screening ring for intercepting a second portion of unreflected light rays from the light source.

7. A lighting unit as claimed in claim 6, characterized in that, the screening ring extends at the side facing the holder up to a plane transverse to the axis of symmetry and defined by the cup-shaped cap.

8. A lighting unit as claimed in claim 6 or 7, characterized in that the screening ring forms part of a conical surface with a maximum apex angle of 10°.

9. A lighting unit as claimed in claim 6, wherein the reflector and the light source are indetachably integrated into a lamp.

10. A lighting unit as claimed in claim 9, characterized in that the lamp is a metal halide lamp with a ceramic discharge vessel.

11. A lighting unit provided with a concave reflector having an axis of symmetry and with a light emission window bounded by an edge of the reflector which surrounds the axis transversely thereto, an elongate light source which is axially arranged substantially on the axis of symmetry and which is accommodated in a holder opposite the light emission window, and a cup-shaped axially positioned cap serving as an optical screening means that partly surrounds the light source for intercepting unreflected light rays from the light source, characterized in that the cap is surrounded by a screening ring forming part of a conical surface.

12. A lighting unit as claimed in claim 11, characterized in that, the screening ring extends at the side facing the holder up to a plane transverse to the axis of symmetry and defined by the cup-shaped cap.

13. A lighting unit as claimed in claim 11 or 12, characterized in that the conical surface has a maximum apex angle of 10°.

14. A lighting unit as claimed in claim 11, wherein the reflector and the light source are indetachably integrated into a lamp.

15. A lighting unit as claimed in claim 14, characterized in that the lamp is a metal halide lamp with a ceramic discharge vessel.

* * * * *